United States Patent [19]

Habarou et al.

[11] Patent Number: 4,669,954

[45] Date of Patent: Jun. 2, 1987

[54] ABRADABLE TURBINE RINGS AND TURBINES THUS OBTAINED

[75] Inventors: Georges Habarou, Le Bouscat; Jacques Etienne, Eysines; Jean-Claude Clébant, Carbon Blanc, all of France

[73] Assignee: Societe Europeenne de Propulsion, Puteaux, France

[21] Appl. No.: 820,107

[22] Filed: Jan. 21, 1986

[30] Foreign Application Priority Data

Jan. 24, 1985 [FR] France ..... 85 00993

[51] Int. Cl.[4] ..... F01D 11/08

[52] U.S. Cl. ..... 415/174; 415/197

[58] Field of Search ..... 415/174, 200, 126, 127, 415/128, 196, 197, 9, 138, 170 R, 134

[56] References Cited

U.S. PATENT DOCUMENTS

| | | | |
|---|---|---|---|
| 3,854,843 | 12/1974 | Penny | 415/197 |
| 4,135,851 | 1/1979 | Bill et al. | 415/174 |
| 4,336,276 | 6/1982 | Bill et al. | 415/174 |
| 4,398,866 | 8/1983 | Hartel et al. | 415/197 |
| 4,488,920 | 12/1984 | Danis | 156/155 |

FOREIGN PATENT DOCUMENTS

| | | | |
|---|---|---|---|
| A0076731 | 4/1983 | European Pat. Off. . | |
| 1541195 | 9/1967 | France . | |
| A2373348 | 10/1977 | France . | |
| 268382 | 6/1928 | United Kingdom | 415/127 |
| 1189698 | 4/1970 | United Kingdom . | |
| 1500135 | 2/1978 | United Kingdom . | |
| 2059806 | 9/1979 | United Kingdom . | |

OTHER PUBLICATIONS

Rapport De Recherche, completed 5-11-85 by Examiner Daeleman P.C.A. at Republique Francaise, Institut National de la Propriete Industrielle.

*Primary Examiner*—Robert E. Garrett
*Assistant Examiner*—John Kwon
*Attorney, Agent, or Firm*—Staas & Halsey

[57] ABSTRACT

The present invention relates to abradable rings for turbines, wherein they are constituted by an abradable refractory material and are formed by at least one open ring maintained clamped against a fixed metallic structure with the aid of at least one spring, and to refractory materials which may be used for making said rings.

6 Claims, 2 Drawing Figures

ABRADABLE TURBINE RINGS AND TURBINES THUS OBTAINED

BACKGROUND OF THE INVENTION

The present invention relates to abradable turbine rings, to a process for preparing them and to the turbines obtained.

The role of a turbine ring is to ensure, at turbine level, the boundary of the gas stream, limiting the direct passage of the gases as best possible. The output of the turbine is therefore connected with the characteristics of this ring on which the blade end clearance depends. In order to be able to minimize this clearance as much as possible, the ring must present two properties:

be constituted by an abradable material, be adjustable so as to be able to provide an active correction of the diameter of the ring as a function of the instantaneous configuration of the motor.

SUMMARY OF THE INVENTION

It is an object of the present invention to propose an acceptable solution to this problem; this solution involves the use of a specific material and a particular structure of the ring.

The particular structure of the abradable ring according to the invention, said ring being mounted inside the metallic structure of the turbine, is characterized in that it is constituted by at least one "open ring" clamped against said metallic structure by at least one spring.

"Open ring" is understood to mean either a ring following virtually the whole of the inner periphery of the metallic structure but comprising a cut having faces between which a spring is inserted, or portions of rings having faces between which a spring is inserted.

It is clear that the opposite faces obtained by the single cut or each cut in the open ring may take the form of baffles so as to improve tightness at these cuts.

Said spring may be composed of any means (draw spring, compression spring, jack) which makes it possible, by applying a suitable force on the single cut or each cut, to apply the "open ring" against the metallic structure of the turbine or against a structure, itself metallic or insulating (ceramic), which may be fitted on said metallic structure of the turbine.

The specific material used is an abradable material obtained by gaseous phase deposit of a refractory material such as silicon carbide and alumina, within a fibrous carbon structure, then elimination of said fibrous carbon structure.

The preferred material is constituted by silicon carbide, presents a porosity of 15 to 20% and is formed by small hollow tubes all having the same direction, substantially that of the radius of the "open ring ".

The fibrous carbon structure in which the deposit of refractory material will be effected may be a random structure (felt) or a more or less ordered structure in which a more or less high proportion of the fibers will be oriented in at least one preferred direction. This orientation may for example be unidirectional and be obtained by combing or equivalent means. The fibrous structure may be more or less densified by deposit, as known, on or between the carbon fibers. Thanks to this possibility of orientation of the carbon fibers, and thanks to the possibility of densification of the carbon fiber structure, the process according to the invention makes it possible to obtain a whole series of novel materials whose properties may be controlled in order to adapt them to the uses envisaged.

It should be pointed out that the gaseous phase deposit of the refractory material in the structure based on carbon fibers may advantageously be effected whilst said structure is being shaped, so as to obtain, directly, a product in its final form, i.e. ready to be assembled or used.

The carbon contained in the complex material obtained (carbon in the form of fibers and possibly densification carbon) is eliminated by any known means, particularly by oxidation. This means that the refractory material deposited must resist the means used for eliminating the carbon.

Products are thus obtained of which the essential feature is that they are in the form of an assembly of small tubes made of refractory material.

When these small tubes are oriented, it is possible that the surfaces of the parts present, with respect to said small tubes, specific orientations; for example, the friction surfaces will be perpendicular to the axis of the tubes; in the latter case, wear of the material will be effected by the rupture, in flexion, of the thin walls of the tubes of refractory material.

Such a material is made by using, according to a non-limiting example, a structure formed by oriented carbon fibers; this structure will for example weigh about 330 g/m$^2$, and will have a proportion of fibers of about 9% and a fiber diameter of 7 to 10 micrometers.

In accordance with the technique of vapour phase deposit, silicon carbide will be deposited in this material and the carbon fibers contained in the material obtained will be eliminated by any known means, for example by dissolution.

Such a material possesses the following qualities:

resistance to corrosion by the combustion products at high temperature (1300° C.) in order to limit the cooling air flowrate, resistance to the thermal cycles, resistance to the thermal shocks, resistance to erosion (but still abradable) due to the impact of fine particles, manufacture able to be reproduced, machining and correction in situ, minimum dimensions and weight.

It has been found according to the invention that said material was particularly suitable for making turbine rings by using the particular structure of the ring as defined hereinabove, the small hollow silicon carbide tubes being oriented substantially perpendicular to the abradable surface.

BRIEF DESCRIPTION OF THE DRAWINGS

The invention will be more readily understood on reading the following description with reference to the accompanying drawings, in which.

DESCRIPTION OF THE PREFERRED EMBODIMENTS

Figure 1:
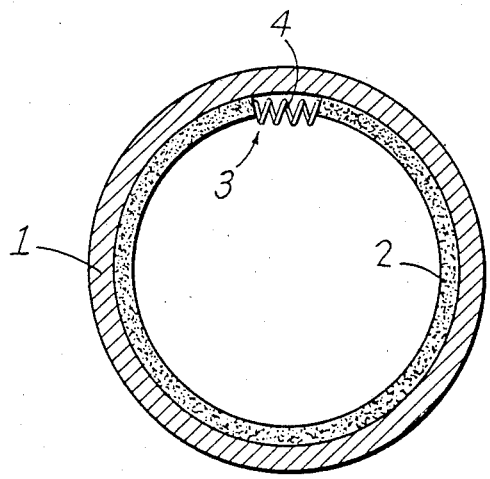
FIG. 1 is a schematic view in section, perpendicular to its axis, of a turbine ring made of abradable material mounted, according to the invention, in a metallic ring.

Referring now to the drawings, FIG. 1 shows the closed metallic ring 1 which constitutes the structure of the turbine and the ring 2 made of abradable material according to the invention. This ring made of abradable material is open (3); the two faces of this opening are compressed by a spring 4 working in compression, said spring being chosen so as to exert on said faces a sufficient force in order to apply the ring made of abradable material permanently on the metallic ring.

The spring 4 may be constituted by a pneumatic jack or a hydraulic jack, or preferably by a leaf spring, either metallic, ceramic, or mixed.

Tightness of the abradable ring at cut 3 will be ensured without major difficulties by employing known means.

Figure 2:
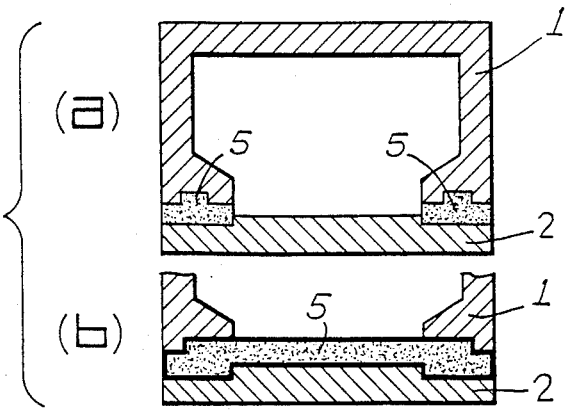
FIG. 2 shows, in axial section, an assembly of the abradable ring on the metallic ring with partial interposition (FIG. 2*a*) or total interposition (FIG. 2*b*) of a ceramic insulating means.

FIGS. 2*a* and 2*b* show:

the closed metallic ring 1 which constitutes the structure of the turbine, the abradable ring 2 which, as shown in FIG. 1, is open and compressed by at least one spring, a ceramic insulating means 5 which may either be located solely at the ends of the metallic ring 1 as in FIG. 2*a*, or extend over the whole of the open surface of this metallic ring as shown in FIG. 2*b;* in this latter case, this insulating layer may contribute to the radial seal of the system.

What is claimed is;

1. A turbine ring assembly comprising:

a fixed outer annular metallic structure;

an inner ring mounted within said fixed outer annular metallic structure and formed by an adradable refractory material, said inner ring being opened at its periphery to leave at least one gap between opposite faces of an opening in said inner ring so as to allow said inner to expand circumferentially; and spring means acting on the opposite faces of the opening in said inner ring to clamp said inner ring radially in the direction of said fixed outer annular metallic structure.

2. A turbine ring assembly as claimed in claim 1, further comprising ceramic insulating means interposed between said inner ring and said fixed outer annular metallic structure.

3. A turbine ring assembly as claimed in claim 1, wherein the abradable refractory material which forms said inner ring is obtained by destruction of carbon in a composite material formed by chemical vapor deposition of a refractory material within a fibrous carbon structure.

4. A turbine ring assembly as claimed in claim 3, wherein said inner ring has an inner abradable surface, wherein said fibrous carbon structure is formed of unidirectional oriented fibers, and wherein the direction of the unidirectionally oriented fibers is substantialy perpendicular to the inner abradable surface of said inner ring.

5. A turbine assembly as claimed in claim 2, wherein the abradable refractory material which forms said inner ring is obtained by destruction of carbon in a composite material formed by chemical vapor desition of a refractory material within a fibrous carbon structure.

6. A turbine ring assembly as claimed in claim 4, wherein said inner ring has an inner abradable surface, wherein said fibrous carbon structure is formed of unidirectionally oriented fibers, and wherein the direction of the unidirectionally oriented fibers is substantially perpendicular to the inner abradable surface of said inner ring.

* * * * *